United States Patent [19]

Green

[11] 4,243,489

[45] Jan. 6, 1981

[54] PYROLYSIS REACTOR AND FLUIDIZED BED COMBUSTION CHAMBER

[75] Inventor: Norman W. Green, Upland, Calif.

[73] Assignee: Occidental Petroleum Corp., Los Angeles, Calif.

[21] Appl. No.: 960,028

[22] Filed: Nov. 13, 1978

Related U.S. Application Data

[63] Continuation of Ser. No. 848,132, Nov. 3, 1977, abandoned, which is a continuation of Ser. No. 699,999, Jun. 25, 1976, abandoned.

[51] Int. Cl.[2] ..... C10B 1/00; C10G 1/00; C10B 49/16

[52] U.S. Cl. ..... 201/12; 48/77; 48/111; 48/209; 48/210; 201/22; 201/25; 201/28; 201/33; 202/99; 202/108; 202/120; 208/8 R; 208/11 R; 432/15; 432/58

[58] Field of Search ..... 201/12, 21, 22, 23, 201/25, 28, 32, 33; 202/99, 108, 120, 121; 48/111, 209, 210, 77 (U.S. only), 101 (U.S. only); 208/8 R, 11 R; 432/15, 58

[56] References Cited

U.S. PATENT DOCUMENTS

| | | | |
|---|---|---|---|
| 1,954,352 | 4/1934 | Dornbrook et al. | 202/108 |
| 2,582,712 | 1/1952 | Howard | 201/31 X |
| 2,608,526 | 8/1952 | Rex | 208/8 R |
| 2,723,951 | 11/1955 | Nimet | 201/9 X |
| 2,741,549 | 4/1956 | Russell | 208/8 R |
| 3,655,518 | 4/1972 | Schmalfeld et al. | 202/108 |
| 3,717,438 | 2/1973 | Schmalfeld et al. | 432/58 X |
| 3,847,566 | 11/1974 | Wilson | 48/202 |
| 3,855,070 | 12/1974 | Squires | 201/31 X |
| 3,867,110 | 2/1975 | Schora et al. | 48/210 |
| 3,876,392 | 4/1975 | Kalina et al. | 48/210 |
| 3,890,111 | 6/1975 | Knudsen | 48/197 R |
| 3,891,402 | 6/1975 | Nahas et al. | 48/197 R |
| 3,904,549 | 9/1975 | Barton et al. | 201/12 X |
| 3,927,996 | 12/1975 | Knudsen et al. | 48/210 X |
| 3,935,466 | 5/1975 | Schoenmakers | 422/141 X |
| 3,957,459 | 5/1976 | Mitchell et al. | 48/210 X |
| 3,958,957 | 5/1976 | Koh et al. | 48/197 R |
| 3,975,168 | 8/1976 | Gorbaty | 48/197 R |
| 3,985,519 | 10/1976 | Kalina et al. | 48/210 X |
| 3,998,607 | 12/1976 | Wesselhoft et al. | 48/210 X |

*Primary Examiner*—Joseph Scovronek
*Attorney, Agent, or Firm*—Christie, Parker & Hale

[57] ABSTRACT

A solid carbonaceous material is pyrolyzed in a descending flow pyrolysis reactor in the presence of a particulate source of heat to yield a particulate carbon containing solid residue. The particulate source of heat is obtained by educting with a gaseous source of oxygen the particulate carbon containing solid residue from a fluidized bed into a first combustion zone coupled to a second combustion zone. A source of oxygen is introduced into the second combustion zone to oxidize carbon monoxide formed in the first combustion zone to heat the solid residue to the temperature of the particulate source of heat.

60 Claims, 3 Drawing Figures

Fig. 1
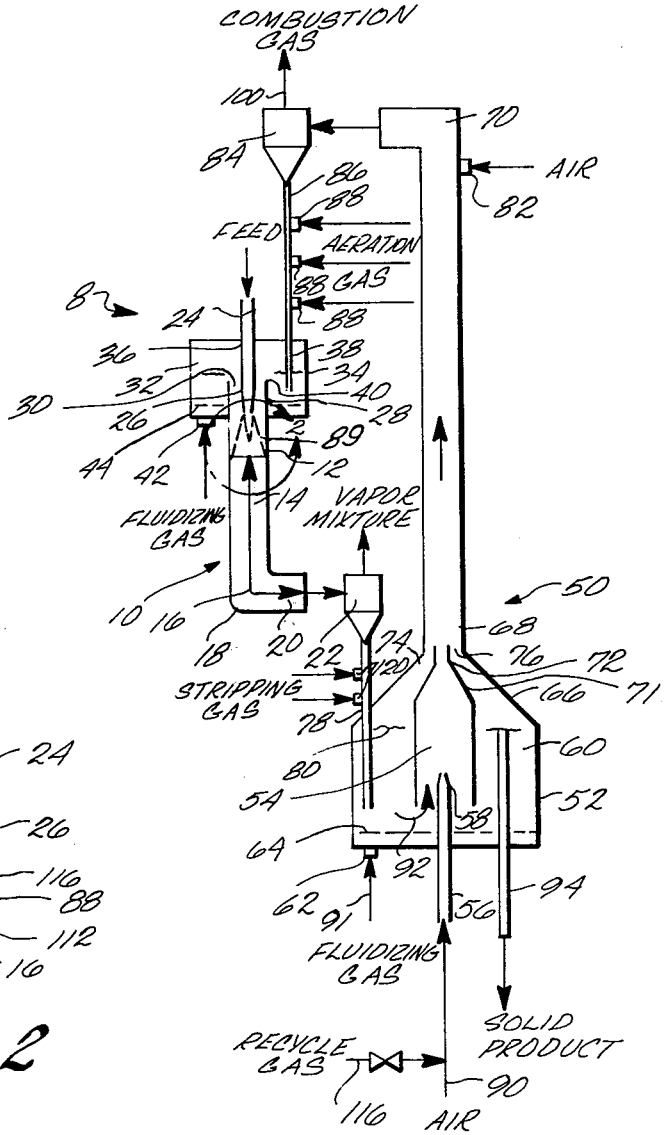
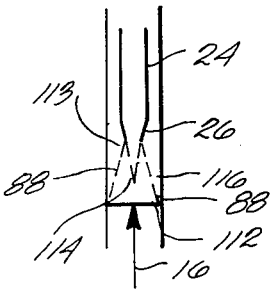
Fig. 2

PYROLYSIS REACTOR AND FLUIDIZED BED COMBUSTION CHAMBER

The Government has rights in or in respect of this invention pursuant to Contract No. E(49-18)-2244 awarded by the U.S. Energy Research and Development Administration.

CROSS REFERENCE TO RELATED APPLICATIONS

This is a continuation of application Ser. No. 848,132, filed Nov. 3, 1977, now abandoned, which is a continuation of application Ser. No. 699,999, filed June 25, 1976, now abandoned.

BACKGROUND OF THE INVENTION

Due to increasing scarcity of fluid fossil fuels such as oil and natural gas, much attention is being directed towards converting solid carbonaceous materials such as coal, oil shale, tar sands, uintaite and solid waste to liquid and gaseous hydrocarbons by pyrolysis. Pyrolysis can occur under nonoxidizing conditions in a pyrolysis reactor in the presence of a particulate source of heat to yield as products pyrolytic vapors containing hydrocarbons and a particulate carbon containing solid residue. The particulate source of heat for effecting the pyrolysis of the carbonaceous material can be obtained by oxidizing carbon in the particulate carbon containing solid residue in a combustion chamber.

There are many problems associated with this scheme of using a pyrolysis reactor and a combustion chamber for obtaining hydrocarbons from solid carbonaceous materials. One of these problems is the caking of coal along the walls of the pyrolysis reactor. Experience with agglomerative coals, particularly Eastern United States coals, indicates that these coals have a tendency to agglomerate in a reactor, especially along the walls of the reactor.

Another problem is how to transfer the particulate carbon containing solid product from the pyrolysis reactor to the combustion chamber while at the same time keeping oxygen in the combustion chamber out of the pyrolysis reactor. If oxygen manages to leak into the pyrolysis reactor, the value of the hydrocarbon product is reduced and a violent explosion may occur.

A third problem is how to maximize production of carbon dioxide and minimize production of carbon monoxide in the combustion zone to maximize recovery of the heating value of the carbon containing solid residue during oxidation. The kinetics and thermodynamic equilibrium of the oxidation of carbon favor increased production of carbon monoxide relative to carbon dioxide at temperatures greater than about 1200° F. at long residence times when there is a stoichiometric deficiency of oxygen. Since pyrolysis of carbonaceous materials often is conducted at temperatures greater than 1200° F. and can approach temperatures higher than 2000° F., it is necessary to form a particulate source of heat having temperatures greater than 1200° F. In addition the particulate carbon containing solid residue is only partially oxidized in a stoichiometric deficiency of oxygen to form the particulate source of heat. Thus production of carbon monoxide inevitably occurs during the oxidation step of the particulate carbon containing solid residue. The carbon monoxide formed represents a loss of thermal efficiency of the process.

Therefore, there is a need for a process and an apparatus for obtaining values from a solid carbonaceous material by pyrolysis which are useful for agglomerative coals; which, when a particulate carbon containing solid residue of pyrolysis of the carbonaceous material is oxidized to form a particulate source of heat to pyrolyze the carbonaceous material, prevent oxygen from entering into the pyrolysis reaction; and which maximize production of carbon dioxide while minimizing production of carbon monoxide.

SUMMARY OF THE INVENTION

According to the present invention, there are provided an apparatus and a process with the above features. In this invention solid carbonaceous material is subjected to flash pyrolysis by transporting particulate solid carbonaceous material feed contained in a carrier gas which is substantially nondeleteriously reactive with respect to products of pyrolysis to a solids feed inlet of a descending flow pyrolysis reactor. The pyrolysis reactor contains a substantially vertically oriented pyrolysis zone operated at a temperature from about 600° to about 2000° F. In addition, a particulate source of heat is fed at a temperature above the pyrolysis temperature to a substantially vertically oriented chamber surrounding the upper portion of the pyrolysis reactor. The particulate source of heat comprises heated carbon containing solid residue of pyrolysis of the carbonaceous material. The inner peripheral wall of the chamber forms an overflow weir to the vertically oriented mixing region of the pyrolysis reactor. The particulate heat source is maintained in a fluidized state in the chamber by an aerating gas which also is substantially nondeleteriously reactive with respect to the products of pyrolysis. The particulate source of heat is discharged over the weir and downwardly into the mixing region at a rate sufficient to maintain the pyrolysis zone at the pyrolysis temperature. Simultaneously the particulate solid carbonaceous material feed and carrier gas are injected from the solids feed inlet into the mixing region to form a resultant turbulent mixture of the particulate source of heat, the particulate carbonaceous feed and the carrier gas. This resultant turbulent mixture is passed downward from the mixing zone to the pyrolysis zone of the pyrolysis reactor. In the pyrolysis zone the carbonaceous material feed is pyrolyzed to yield a pyrolysis product stream containing as solids, the particulate source of heat and char, and a vapor mixture of carrier gas and pyrolytic product vapors comprising hydrocarbons. The pyrolysis product stream is then passed to a first separation zone such as a cyclone separator to separate at least the bulk of the solids from the vapor mixture.

The particulate source of heat used in the pyrolysis reactor is formed by transporting at least a portion of the separated solids to a fluidized bed around a substantially vertically oriented open conduit. This conduit is in open communication with a substantially vertically oriented riser. The conduit and riser together comprise a first combustion zone. A gaseous source of oxygen is injected upwardly into the conduit to educt solids from the fluidized bed into the conduit to oxidize carbon in the solids in the first combustion zone, thereby heating the solids, and to transport the educted solids and gaseous combustion products of the solids, including carbon monoxide, through the riser to a second combustion zone. A source of oxygen is introduced into the second combustion zone in an amount at least equal to 50% of the molar feed of carbon monoxide to the second combustion zone, the total oxygen fed to the first and second combustion zones being sufficient to generate the particulate source of heat.

The formed particulate source of heat and the gaseous combustion products of the solids are passed from the second combustion zone to a second separation zone such as a cyclone separator. In the second separation zone the particulate source of heat is separated from the gaseous combustion products for feed to the chamber surrounding the upper portion of the pyrolysis reactor, preferably through an aerated dipleg or standpipe.

Preferably, the conduit is vertically spaced apart from the riser so that the fluidizing gas used to fluidize the fluidized bed can pass into the riser through the space between the conduit and the riser to help transport the educted solids into the second combustion zone.

In the process of this invention, pyrolysis occurs at a temperature from about 600° to about 2000° F. Short reaction time and low temperatues in the pyrolysis reaction zone enhance formation of the middle distillate hydrocarbons, i.e., hydrocarbons in the range of $C_5$ hydrocarbons to hydrocarbons having an end point of 950° F. As a consequence, it is preferred to conduct pyrolysis so that the residence time of the carrier gas in the pyrolysis section of the pyrolysis reactor and the first separator is less than about 5 seconds, and more preferably less than about 3 seconds. It also is preferred that pyrolysis be conducted at a temperature from about 900° to 1400° F. To achieve pyrolysis the solid particulate source of heat generally is introduced at a temperature from about 100° to about 500° F. higher than the pyrolysis temperature to be achieved. The weight ratio of the particulate source of heat to the carbonaceous feed ranges from about 2 to about 20.

To provide turbulence to obtain rapid heat transfer from the particulate source of heat to the carbonaceous material, the turbulent mixture preferably has a solids content ranging from about 0.1 to about 10% by volume based upon the total volume of the stream.

To heat the solids in the fluidized bed, a source of oxygen can be supplied along with the gas used to fluidize the solids in the fluidized bed. The oxygen exothermically combines with carbon contained in the solids.

The process and apparatus of this invention have many advantages. Among these is improved process control because of a reservoir of the particulate source of heat behind the weir and a reservoir of the carbon containing solid residue in the fluidized bed. These solid reservoirs dampen the effect of minor system upsets. Another advantage is that agglomerative coals can be processed with the process and apparatus of this invention because the turbulent flow in the mixing region prevents buildups of coal on the reactor walls. In addition, high yield of the valuable middle distillates can be obtained by operating the process under the preferred conditions. Furthermore, the differential pressure provided by the fluidized bed prevents oxygen used for oxidizing the carbon in the carbon containing solids residue from entering the pyrolysis reaction zone. This prevents degradation of hydrocarbon product quality and serves to prevent a dangerous explosion from occurring when oxygen leaks into the pyrolysis reactor. In addition, the fluidized bed can also serve as a source of ignition during startup.

Another advantage of the method and apparatus of this invention is that high thermal efficiencies are achieved because carbon monoxide formation is minimized due to the introduction of an air source into the second combustion zone.

These and other features, aspects and advantages of the present invention will become more apparent with reference to the accompanying drawings, detailed description of the invention, and appended claims.

DRAWINGS

FIG. 1 illustrates a process and an apparatus embodying features of this invention;

FIG. 2 is a detailed view of the area 2 in FIG. 1; and

DETAILED DESCRIPTION OF THE INVENTION

Figure 3:
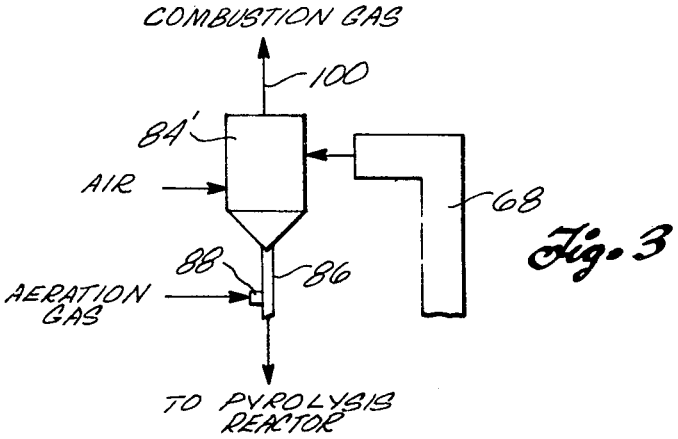
FIG. 3 illustrates a portion of another process and an apparatus embodying features of the invention.

According to the present invention, there is provided a process and an apparatus for the pyrolysis of solid carbonaceous materials, including agglomerative coals, in the presence of a particulate source of heat obtained from the partial oxidation of a carbon containing solid residue resulting from pyrolysis of the carbonaceous material. This apparatus and process maximize the heating value obtained from oxidation of the carbon containing solid residue and prevent oxygen from entering the pyrolysis reactor.

Solid carbonaceous materials which are pyrolyzed in accordance with the present invention include tar sands, oil shale, the organic portion of solid waste, nonagglomerative and especially agglomerative coals, and the like, as well as mixtures thereof.

Referring to the Drawings, there is provided a pyrolysis unit 8 comprising a descending flow pyrolysis reactor 10 which has a substantially vertically oriented mixing section or zone 12 and a substantially vertically oriented pyrolysis section or zone 14 below the mixing section. Arrow 16 in FIG. 1 shows the approximate boundaries of the pyrolysis section. The reactor has an elbow 18 towards the end of the pyrolysis section which can be supported. The lower end 20 of the reactor terminates in a separation zone such as first cyclone separator 22.

A generally upright annular solids feed inlet 24 terminating within the mixing section 12 and constricted at its end to form a nozzle 26 is provided for introducing a solid carbonaceous material into the mixing region.

The upper end 28 of the reactor is open and of larger diameter than the nozzle 26, thereby leaving an annular gap 30 between the upper end 28 of the reactor and the nozzle 26. A vertically oriented fluidizing chamber or well 32 surrounds the upper portion of the reactor and is formed by a preferably annular section 34 which connects the wall 36 of the solids feed inlet above where the wall constricts to form the nozzle 26 and the upper portion 28 of the reactor. The chamber 32 surrounds the nozzle 26 and a portion of the upper wall 28 of the reactor. The inner peripheral wall of the chamber 32 is formed by the upper wall 28 of the reactor and serves as an overflow weir to the mixing section 12 of the reactor 10.

A second vertically oriented solids inlet 38 is provided. The second inlet terminates in the annular fluidizing chamber 32, preferably at a level below the top edge 40 of the pyrolysis reactor 10.

There is a gas inlet 42 to the bottom of the fluidizing chamber for a fluidizing gas. Means are provided such as a cylindrical, horizontally oriented, perforated plate 44 positioned towards the bottom of the fluidizing chamber below the end of the second inlet for distributing the fluidizing gas so that the fluidizing gas flows upwardly through the fluidizing chanber.

The first cyclone separator 22 serves to separate a particulate carbon containing solid residue of pyrolysis from the gaseous products of pyrolysis.

The particulate source of heat for the pyrolysis reactor is formed by oxidizing at least a portion of the particulate carbon containing solid residue in a combustion unit 50. The combustion unit includes a vessel 52 containing a fluidized bed 60 of a particulate carbon containing solid residue around an open, substantially vertically oriented conduit or tube 54. There is a gas inlet 56 for a transport gas at the base of the vessel 52 which narrows down to form a vertically oriented nozzle 58 for injection of the transport gas directly upwardly into the open conduit 54. The fluidized bed 60 of carbon containing solid residue is fluidized by a fluidizing gas entering the chamber through a gas inlet 62 at the base of the vessel. The fluidizing gas is distributed throughout the fluidized bed by means of a second, horizontally oriented perforated distributor plate 64.

The top 66 of the vessel 52 tapers upwardly and inwardly to connect to a vertically oriented riser 68. The riser and conduit comprise a first combustion zone or chamber. The riser couples the vessel 52 to a second combustion zone or chamber 70. The conduit 54 is below the riser 68 and the top edge 72 of the conduit is spaced apart from the riser so that an annular gap or space 74 is formed between the inlet 76 to the riser and the top edge 72 of the conduit. The top portion 71 of the conduit can be tapered inwardly so that the diameter of the conduit at its top edge is smaller than the diameter of the riser.

A vertically oriented standpipe or dipleg 78 having stripping gas inlets 120 extends from the bottom of the first cyclone separator 22 into the vessel 52 below the top 80 of the fluidized bed of carbon containing solid residue. Solids separated by the first cyclone separator are transferred through this dipleg into the vessel.

There is an inlet 82 at the upper portion of the riser 68 for introduction of a source of oxygen into the second combustion chamber 70. The second combustion chamber is in open communication with a second separator such as cyclone separator 84. This separator serves to separate a particulate source of heat generated in the combustion unit 50 from any combustion gases present in the combustion unit. The particulate source of heat is transferred from the second cyclone separator 84 to the second inlet 38 of the pyrolysis reactor through a vertically oriented dipleg or standpipe 86 originating at the bottom of the second cyclone separator 84 and terminating in the second inlet 38. The length of the standpipe 86 is chosen to balance the accumulation of differential pressures throughout the remainder of the system. Inlets 88 for a stripping or aerating gas are provided along the length of the standpipe 86.

In summary, what has been described is an apparatus for pyrolysis of a solid carbonaceous material comprising two main units, a pyrolysis unit 3 and a combustion unit 50 including a riser 68. These two units are coupled by two cyclone separators 22, 84 and two vertically oriented standpipes or diplegs 78,86 which allow carbon containing solid residue to be transferred from the pyrolysis unit to the combustion unit and particulate source of heat to be transferred to the combustion unit to the pyrolysis unit, respectively.

In the process of this invention, a particulate solid carbonaceous material is subjected to flash pyrolysis by transporting the particulate solid carbonaceous material feed contained in a carrier gas to the feed nozzle 26 through the first feed inlet 24 to the pyrolysis reactor 10. The carrier gas is substantially nondeleteriously reactive with respect to the products of pyrolysis and may serve as a diluent to prevent self-agglomeration of the carbonaceous material.

As used herein, by a "nondeleteriously reactive" gas there is meant a gas stream which is essentially free of free oxygen. Although constituents of the gas may react under nonoxidizing conditions with pyrolysis products to upgrade their value, to be avoided are constituents which degrade pyrolysis products. The carrier gas may, for instance, be the off gas product of pyrolysis, steam which will react under suitable conditions with char or coke formed from pyrolysis to yield by water-gas shift reactions, hydrogen, which serves to react with and stabilize unsaturates in the products of pyrolysis, any desired inert gas, or mixtures thereof. The carrier gas can be synthesis gas, especially a hydrogen enriched synthesis gas.

The carbonaceous material may be treated before it is fed to the pyrolysis reactor by processes such as removal of inorganic fractions by magnetic separtion and classification, particularly in the case of municipal solid waste. The carbonaceous material also can be dried to reduce its moisture content. The solid carbonaceous material usually is comminuted to increase the surface area available for pyrolysis.

Preferably a substantial portion of the carbonaceous material is of a particle size of less than about 1000 microns to present a large surface to volume ratio to obtain rapid heating of the coal in the pyrolysis zone. Rapid heating results in improved yields of hydrocarbons. For an agglomerative coal, preferably the coal is substantially of a particle size less than about 250 microns because agglomerative coals are well known to plasticize and agglutinate at relatively low temperatures, i.e., 400° to 850° F. An agglomerative coal should be rapidly heated through the plastic state before it strikes the wall of a pyrolysis reactor to prevent caking on the reactor walls. Since the rate at which a coal particle can be heated increases as particle size decreases, it is important that an agglomerative coal be comminuted to 250 microns or less, depending on the size and configuration of the pyrolysis reactor, so that substantially all the coal particles are not tacky by the time the coal particles strike a reactor wall. For example, when a bituminous high volatile C coal which agglomerates at temperatures above about 500° F. is pyrolyzed in a 10 inch diameter pyrolysis reactor of the design shown in FIG. 1 and described below at a temperature of 1075° F., the coal is comminuted to a size less than 250 microns in diameter to prevent caking on the reactor walls. Coal particles larger than 250 microns in diameter could strike the reactor walls before passing through the plastic state.

The carbonaceous material introduced into the pyrolysis reactor can be provided substantially free of fines less than about 10 microns in diameter, because carbon containing solid residue fines resulting from pyrolysis of the carbonaceous material have a tendency to be carried into and contaminate the liquid hydrocarbon products.

Simultaneously with the introduction of the carbonaceous material feed, there is introduced a particulate source of heat into the fluidizing chamber 32 through the second vertically oriented inlet 38. Because in the preferred embodiment the second inlet 38 terminates below the top edge 40 of the pyrolysis reactor 10, incoming particulate source of heat builds up in the fluidizing chamber below the weir 28 to form a solids seal. The particulate source of heat in chamber 32 is maintained in a fluidized state in the chamber by introduction of a fluidizing gas stream through the gas inlet 42. The fluidizing gas is distributed by the distributor plate 44 to maintain the particulate source of heat in a fluidized state throughout the chamber. As additional particulate source of heat is introduced into the chamber the particulate source of heat passes over the upper end 40 of the weir and through the opening 30 between the weir and the nozzle 26 into the mixing section 12 of the pyrolysis reactor 10 with aid of fluidizing gas. An advantage of this weir-like configuration is that an essentially steady flow of fluidized particulate source of heat enters the mixing section because the mass of the particulate source of heat backed up behind the weir of the reactor dampens minor fluctuations in the flow of the particulate source of heat.

In the mixing zone of the pyrolysis reactor, the carbonaceous material contained in the carrier gas is discharged from the nozzle as a fluid jet 112 expanding towards the reactor wall at an angle of about 20° or less as shown by dotted lines 88 in the Drawings which represent the periphery of the fluid jet. Once the particulate source of heat is inside the mixing section, it falls into the path of the fluid jet 112 of the carbonaceous material feed stream and carrier gas coming from the nozzle and is entrained thereby, yielding a resultant turbulent mixture of the particulate source of heat, particulate solid carbonaceous material feed, and the carrier gas. The jet has a free core region 113 of carbonaceous material, as delineated by the V-shaped dotted line 114 in FIGS. 1 and 2, extending considerably into the reactor, but as the jet expands, the particulate source of heat present is entrained with mixing of the carbonaceous material in the portion of the fluid jet 112 around the free core region 113. The particulate source of heat along the periphery 89 of the fluid jet preferably heats the carbonaceous material in the case of an agglomerative coal to a temperature above the temperature at which the coal is tacky. In the region 116 between the reactor walls and the fluid jet 112, there is unentrained particulate source of heat.

This mixing of the particulate source of heat with the solid carbonaceous material in the mixing zone 12 initiates heat transfer from the particulate solid source of heat to the carbonaceous material, causing pyrolysis in the pyrolysis section 14 of the pyrolysis reactor 10. Pyrolysis is a combination of vaporization and cracking reactions. As the vaporization and cracking reactions occur, condensible and noncondensible hydrocarbons are generated from the carbonaceous material. with an attendant production of a carbon containing solid residue such as coke or char. An effective pyrolysis time is less than about 5 seconds, and preferably from about 0.1 to about 3 seconds, to maximize yield of middle distillates. Middle distillates are the middle boiling hydrocarbons, i.e., $C_5$ hydrocarbons to hydrocarbons having an end point of about 950° F. These hydrocarbons are useful for the production of gasoline, diesel fuel, heating fuel, and the like.

As used herein, "pyrolysis time" means the time from when the carbonaceous material contacts the particulate source of heat until the pyrolytic vapors produced by pyrolysis are separated from the particulate source of heat in the first separation zone 22, as described below.

A convenient measure of pyrolysis time is the average residence time of the carrier gas in the pyrolysis section 14 of the pyrolysis reactor and the first separator 22. Sufficient pyrolysis time must be provided to heat the carbonaceous material to the pyrolysis temperature.

An advantage of the pyrolysis reactor shown in the Drawings is that due to the turbulent flow the solid carbonaceous material feed is heated rapidly which improves yields. In the case of agglomerative coals, buildups of coal particles on the reactor walls are provided by the rapid heating and turbulent flow. Preferably the particulate source of heat enters the mixing section 12 at a rate of flow less than turbulent and the solid carbonaceous material enters the mixing section through the nozzle under turbulent flow at a rate sufficiently high that the resultant stream from these two inlet streams is under turbulent flow. Turbulent flow results in intimate contact between the solid carbonaceous material and particulate source of heat particles, thereby yielding rapid heating of the carbonaceous material. In the case of an agglomerative coal, the turbulence results in mixing of the particulate souce of heat with the coal particles in the inner portion of the fluid jet, thereby quickly heating these coal particles through the tacky/plastic state. As used herein, turbulent means the stream has a Reynolds flow index number greater than 2000 as calculated by the velocity of the carrier gas at operating conditions. Laminar flow in the pyrolysis reactor tends to severely limit the rate of heat transfer within the pyrolysis zone. Process parameters such as the nozzle diameter and mass flow rate of the carbonaceous material and its carrier gas are varied to maintain the flow rate of the particulate stream entering the first inlet in the turbulent region.

The end of the solids feed inlet preferably is cooled as by water when pyrolyzing an agglomerative coal because the inlet can be heated above the point at which the coal becomes tacky due to heat transfer from the particulate source of heat surrounding the end of the solids feed inlet.

Although FIGS. 1 and 2 show a solids feed inlet 24 having a nozzle 26 at the end to achieve high inlet velocities into the mixing region, a nozzle type inlet is not required. Alternatively, the carbonaceous material and its carrier gas can be supplied at a sufficient velocity to the inlet 24 so that the resultant mixture is under turbulent flow without need for a nozzle.

The hot particulate solid source of heat is supplied at a rate and a temperature consonant with maintaining a temperature in the pyrolysis zone suitable for pyrolysis. Pyrolysis initiates at about 600° F. and may be carried out at temperatures above 2000° F. Preferably, however, pyrolysis is conducted at a temperature from about 900° to about 1400° F. to maximize the yield of middle boiling point hydrocarbons. Higher temperatures, by contrast, enhance gasification reactions. The maximum temperature in the pyrolysis reactor is limited to the temperature at which the inorganic portion of the particulate source of heat or carbonaceous material softens with resultant fusion or slang formation.

Depending upon pyrolysis temperature, normally from about 2 to about 20 pounds of particulate solid source of heat are fed per pound of carbonaceous material entering the reactor. At these ratios, the particulate source of heat is introduced to the reactor at a temperature from about 100° to about 500° F. above the desired pyrolysis temperature. The solids employed may be solids provided external to the process such as sand or the solid product resulting from pyrolysis of the carbonaceous material, such as char or coke, or, in the instance of municipal solid waste, the glass-like inorganic residue resulting from the decarbonization of the solid residue of pyrolysis. The particulate source of heat serves to prevent agglomeration of the carbonaceous material and to provide the heat required for the endothermic pyrolysis reaction.

For economy the amount of fluidizing gas injected through inlet 42 into the fluidizing chamber is maintained at as low a level as possible subject to the constraint that the particulate source of heat be maintained in a fluidized state. Preferably at least a portion of the fluidizing gas is admitted into the mixing section of the reactor to prevent eddy formations with resultant backmixing of partially spent particulate source of heat. The quality of carrier gas injected with the solid carbonaceous material is that which maintains turbulent flow during the process of the solid carbonaceous material through the plastic state in the case of an agglomerative coal. Sufficient carrier gas must be injected to prevent undesirable pressure fluctuations due to flow instabilities. The amount of gas employed to transport the solid carbonaceous material is sufficient to avoid plugging in the reactor, and normally in excess of that amount to dilute the solid materials and prevent self-agglomeration in the case of an agglomerative coal.

Generally high solids content in the pyrolysis feed stream is desired to minimize equipment size and cost. However, preferably the resultant turbulent mixture contains sufficient carrier gas that it has a low solids content ranging from about 0.1 to about 10% by volume based on the total volume of the stream to provide turbulence for rapid heating of the coal and to dilute the carbonaceous material and help prevent self-agglomeration, particularly when processing an agglomerative coal. Rapid heating results in high yields and prevents agglutination of agglomerative coals.

The size and configuration of the pyrolysis reactor are chosen to maintain the desired residence time for the pyrolysis reactor. Generally, as the pyrolysis temperature is reduced, longer residence times are used to maintain the desired yield of volatilized hydrocarbons.

For economy, the pressure in the pyrolysis reactor is typically greater than atmospheric to compress the vapors formed during pyrolysis so that low volume separation equipment downstream of the reactor can be used.

A pyrolysis product stream is passed from the end 20 of the pyrolysis reactor 10 to the first cyclone separator 22. The pyrolysis product stream contains as solids, the particulate source of heat and the particulate carbon containing solid residue of pyrolysis, and a vapor mixture of carrier gas and pyrolytic vapors comprising noncondensible hydrocarbons and condensible hydrocarbons. Preferably the first cyclone separator is in open communication with the lower end 20 of the pyrolysis reactor so that a quick separation of the vapors from the solids can be effected to minimize pyrolysis time so that the vapors can be quenched to prevent cracking reactions from occurring which tend to decrease the recovery of middle distillates from the pyrolytic vapor. In the cyclone separator 22 at least the bulk of the solids are separated from the vapor mixture. The vapor mixture contains pyrolytic vapors containing volatilized hydrocarbons, inert carrier gases, and nonhydrocarbon components such as hydrogen sulfide which may be generated in the pyrolysis reaction.

The volatilized hydrocarbons produced by pyrolysis consist of condensible hydrocrbons which may be recovered by contacting the volatilized hydrocarbons with condensation means, and noncondensible hydrocarbons such as methane and other hydrocarbon gases which are not recoverably by ordinary condensation means. Condensible hydrocarbons can be separated and recovered by conventional means such as venturi scrubbers, indirect heat exchangers, wash towers, and the like. The undesirable gaseous products can be removed from the uncondensible hydrocarbons by means such as chemical scrubbing. Remaining uncondensed hydrocarbons can be sold as a product gas stream and can be utilized as the carrier gas for carrying the carbonaceous material to the pyrolysis reaction zone.

The particulate source of heat is formed in the combustion unit 50. The solids separated in the first cyclone separator 22 are passed down through the dipleg 78 into the fluidized bed 60 containing spent particulate source of heat and the carbon containing solid residue of pyrolysis. As the solids drop down through the dipleg, hydrocarbons on the surface of the solids are stripped by an upward flow of stripping gas, nondeleteriously reactive with respect to pyrolysis products, such as steam. The stripping gas is introduced through gas inlets 120 on the side of the dipleg. The bed 60 is maintained in a fluidized state by an upward flow of fluidizing gas stream 91 into the vessel 52 through the gas inlet 62 and distributed by the distributor plate 64. The fluidizing gas can be nonreactive with respect to the solids in the fluidized bed such as where the off gas product of pyrolysis is used, or may contain a portion of the oxygen required for oxidizing the solids to form the particulate source of heat.

A transport gas is introduced upwardly through the gas inlet 56 and nozzle 58 into the riser 54. The transport gas preferably contains free oxygen. Other reactants which lead to the formation of carbon monoxide may be present. These include steam and carbon dioxide. When steam is present, hydrogen also is formed.

In the preferred process, the transport gas contains, as indicated, some oxygen to generate a portion of the heat necessary to raise the char to the temperature required for feed to the pyrolysis reactor in the first combustion zone. However, the amount of oxygen is limited for if there is too much oxygen in the transport gas, the carbon monoxide generated in the transport line can not be converted to carbon dioxide in the second combustion zone without introducing so much additional oxygen to the second combustion zone that the char would be raised to a temperature above the temperature required for feed to the pyrolysis reactor.

With reference to FIG. 1, the transport gas can be an air stream 90 introduced upwardly through the gas inlet 56 and nozzle 58 into the conduit 54. A sufficient supply of this air stream at an appropriate oxygen content is maintained to: (1) educt solids from the fluidized bed into the conduit; (2) to oxidize a portion of the carbon in the solids to heat the solids in the conduit and riser; and (3) to transport the solids and combustion products, including carbon monoxide, of the solids upwardly through the vertical riser 68 into the second combustion zone chamber 70. The fluidizing gas stream 91 passes through the annular or space gap 74 between the upper edge 72 of the conduit and the vertical riser 68 to halp carry the solids upwardly into the second combustion chamber 70. If the top portion 71 of the conduit is smaller in diameter than the riser, the flow of gas and solids upwardly into the riser from the conduit can serve to educt the fluidizing gas into the riser through the annular gap 74.

The velocity of the transport gas is maintained sufficiently high to educt solids into the conduit and convey them into the second combustion zone. For example, when the transport gas contains air as a source of oxygen, a diluent gas essentially free of free oxygen such as nitrogen or flue gas can be combined with the air to provide an oxygen lean carrier gas having sufficient velocity to educt and transport the solids without introducing too much oxygen to generate too much carbon monoxide. By diluting the heated air stream, a carrier gas stream containing less than about 20% oxygen by volume is formed.

The amount of oxygen in the transport gas is controlled to maintain the desired temperature in the riser. This is always less than the stoichiometric amount required to completely oxidize the char. Due to this deficiency of oxygen and the relative high temperature in the riser, which can range up to about 1100° F. in the case of a pyrolysis reaction zone maintained at about 600° F. to over 2000° F. for a pyrolysis reaction zone maintained at a temperature to enhance gasification, appreciable amounts of carbon monoxide are formed.

Also, as the solids and combustion gases pass upwardly through the riser 68, carbon dioxide introduced in the transport gas and carbon dioxide formed by oxidation of char tends to react with additional carbon in the char to form carbon monoxide according to the reaction:

$$C+CO_2 \rightarrow 2CO$$

Thus generally, less than about half, and usually from about 20 to about 50% of the oxygen required to form the particulate source of heat is in the transport gas. The remainder of the oxygen required is introduced into the second combustion zone to oxidize the carbon monoxide from the first combustion zone to carbon dioxide.

Excess solids in the fluidized bed beyond what is required for oxidation to form the particulate source of heat represent the net solid product of the pyrolysis reaction, and are withdrawn from the first chamber through line 94.

The configuration of the combustion unit shown in the Drawings and described above has many advantages. Among these is instant ignition of the solids in the fluidized bed 60 due to the well mixed aspect of the fluidized bed. When exposed to a source of oxygen the carbon in the carbon containing solid residue is readily oxidized. If the carbon containing solid residue has poor ignition properties, oxygen can be introduced with the fluidizing gas to oxidize carbon in the solids in the fluidized bed to raise the temperature of the fluidized bed. During startup a fuel gas followed by air can be utilized as a fluidizing gas to elevate the temperature of the solids in the fluidized bed above the solids ignition temperature.

Another advantage of the scheme shown in the drawings and described above is that the temperature in the first combustion chamber is easily controlled by controlling the amount of oxygen fed to the fluidized bed in the fluidizing gas stream 90.

Another advantage results from the large inventory of solids in the fluidized bed. Because of this large inventory minor system upsets are dampened by changes in the level of the fluidized bed. As the level in the fluidized bed increases, additional solids are removed through the withdrawal line 94 and additional solids are educted by the transport gas because of the higher differential pressure of the solids due to the increase in height of the bed. Conversely, as the level in the bed decreases fewer solids are withdrawn as product and less solids are educted by the transport gas because the differential pressure of the bed decreases. If any additional controls on the level of the fluidized bed are required, the jet flow of the source of oxygen can be varied. Thus the fluidized bed is a self-compensating system.

Another advantage of the configuration of the first combustion chamber and vessel is that because the solids are fluidized in the fluidized bed, withdrawal of solid product is facilitated. As the level of the solids in the fluidized bed rises, more solids are automatically withdrawn through the solids outlet line 94. This line extends upwardly into the vessel 52 and its height determines the average top 80 of the fluidized bed in the vessel.

A major advantage of the scheme shown in the Drawings is that it provides a comparatively "fail-safe" method of preventing oxygen in the combustion unit 50 from entering the pyrolysis section 8. The height of the bed acts as a barrier against the backflow of oxygen through the dipleg 78 into the pyrolysis reactor. In addition, automatic control means can be provided to sense the level of the fluidized bed, and if the level drops too low, the control means can automatically cut off the flow of the source of oxygen into the first combustion chamber.

A source of oxygen is introduced through the gas inlet 82 into the second combustion zone. The amount of free oxygen introduced into the second combustion zone equals at least 50% of the molar amount of carbon monoxide entering the stage to completely oxidize carbon monoxide generated in the first combustion zone so the total potential heating value of the char oxidized in the first combustion zone is obtained. In addition, oxygen above the stoichiometric amount can be added to react with the carbon in the char to heat the char to the temperature required to form the particulate source of het for introduction into the pyrolysis zone. The total oxygen feed to the two oxidation stages is at all times sufficient to raise the solids to the temperature required for feed to the pyrolysis zones. Typically the particulate source of heat has a temperature from about 100° to 500° F. higher than the pyrolysis zone temperature.

Introducing oxygen to oxidize carbon in the solid residue in two combustion zones serves to obtain maximum heating value from solid residue by oxidation. When the solid residue is oxidized where there is less than stoichiometric amounts of oxygen and/or the residence time is long, then some of the carbon dioxide in the reaction product gases tends to react with carbon in the solid residue to produce carbon monoxide. This is undesirable because more valuable carbon containing solids residue has to be burned to achieve desired temperatures than if carbon dioxide were the only product. Net carbon monoxide formed is minimized and the carbon dioxide to carbon monoxide ratio maximized to maximize the amount of heat generated per unit free carbon combusted by using two combustion zones.

The formed particulate source of heat and the gaseous combustion products of the solids, as well as nonreactive components of the source of oxygen such as nitrogen, pass from the second combustion chamber to a second cyclone separator 84. In the separator the particulate souce of heat is separated from the combustion gases for feed to the pyrolysis reaction zone. The gases 100 are discharged through the top of the cyclone 84. Because most of the carbon monoxide formed in the riser and conduit is oxidized to carbon dioxide in the oxidation zone, the combustion gases can be directly released to the atmosphere. However, if there are appreciable amounts of carbon monoxide or other pollutants in the combustion gas stream 100 from the second cyclone separator 84, these gases can be treated as by chemical scrubbing before release to the atmosphere.

Although FIG. 1 shows the second combustion zone 70 and the second cyclone separation zone 84 as separate apparatuses, it is possible to form the particulate source of heat from the preheated solids and separate the particulate source of heat from the gaseous combustion products simultaneously in a single cyclone oxidation-separation zone 84' as shown in FIG. 3.

This version of the invention has significant advantages. Among these advantages are reduced capital and operating costs for the process because a separator and a combustion zone are replaced with a single cyclone separator 84'. In addition, production of carbon monoxide is minimized because short reaction times which favor production of carbon dioxide are obtained by using a cyclone vessel for oxidizing the carbon containing solid residue. It is preferred that the residence times of solids in a cyclone oxidation-separation zone 84' be less than about 5 seconds, and more preferably, from about 0.1 to about 3 seconds. This short residence time favors production of carbon dioxide compared to carbon monoxide.

Another advantage of using a cyclone oxidation-separation zone is that carbon containing solid residue fines, which are less valuable than larger particles, are burned preferentially because of the more efficient separation of the larger particles from the fines in the cyclone.

The formed particulate source of heat separated from the gases in the second cyclone separation zone is passed through the standpipe 86 to the fluidized chamber 32 surrounding the inlet to the pyrolysis reactor. The standpipe is fluidized by an aeration gas nondeleteriously reactive with respect to pyrolysis products. The aeration gas is introduced through the inlets 88 along the length of the standpipe.

Although this invention is described in terms of certain preferred versions thereof, other versions of this invention are obvious to those skilled in the art. For example, steam can be injected along with the carbon containing solid residue to the fluidizing chamber 32 to react with the hot particulate source of heat to form hydrogen gas by water-gas shift reactions. The hydrogen so produced can hydrogenate the volatilized hydrocarbons resulting from the pyrolysis of the carbonaceous material to upgrade their value. In addition, one or more cyclones in series or parallel as required can be used to replace the cyclone separators 22, 84. The advantage of using more than one cyclone in series is that a fines fraction of the carbon containing solid residue and a fines fraction of the particulate source of heat can be removed from the bulk of the particles so that the amount of solids carried over with the vapor mixture to a product recovery operation is minimized. Because of variations such as these, the spirit and scope of the appended claims should not be necessarily limited to the description of the versions of the invention described above.

What is claimed is:

1. In a process for pyrolysis of particulate solid carbonaceous materials in which a particulate solid carbonaceous material is pyrolyzed by heat transferred thereto by a particulate source of heat to yield a particulate carbon containing solid residue as a product of pyrolysis and in which the particulate source of heat is formed by oxidizing at least a portion of the particulate carbon containing solid residue, the improvement which comprises forming the particulate source of heat by the steps of:

(a) transporting at least a portion of the particulate carbon containing solid residue formed by pyrolysis of the particulate solid carbonaceous material to a fluidized bed around a substantially vertically oriented, open conduit in open communication with a substantially vertically oriented riser, the conduit and riser comprising a first combustion zone;

(b) educting particulate carbon containing solid residue from the fluidized bed upwards into the first combustion zone by injecting a gaseous source of oxygen upwardly into the conduit to oxidize carbon in the particulate carbon containing solid residue thereby partially heating the particulate carbon containing solid residue and transporting the particulate carbon containing solid residue and gaseous combustion products of the particulate carbon containing solid residue, including carbon monoxide, to a second combustion zone; and (c) introducing a source of oxygen into the second combustion zone in an amount at least equal to 50% of the molar feed of carbon monoxide to the second combustion zone for oxidation of such carbon monoxide in the second combustion zone, the total oxygen fed to the first and second combustion zones being sufficient to generate the particulate source of heat.

2. The method of claim 1 in which the conduit is spaced apart from the riser, and the particulate carbon containing solid residue is fluidized in the fluidized bed by an upward flow of a fluidizing gas, and wherein fluidizing gas passes into the riser through the space between the riser and the conduit.

3. The method of claim 1 in which the fluidized bed is fluidized by a fluidizing gas containing oxygen.

4. A continuous process for pyrolysis of particulate solid carbonaceous materials which comprises, in combination, the steps of:

(a) subjecting a particulate solid carbonaceous material to flash pyrolysis by continuously:

(i) transporting the particulate solid carbonaceous material contained in a carrier gas which is substantially nondeleteriously reactive with respect to products of pyrolysis of the particulate solid carbonaceous material to a substantially vertically oriented, descending flow pyrolysis reactor containing a pyrolysis zone operated at a pyrolysis temperature below about 2000° F.;

(ii) feeding a particulate source of heat at a temperature above the pyrolysis temperature and comprising heated particulate carbon containing solid residue of pyrolysis of the particulate solid carbonaceous material to the pyrolysis reactor at a rate sufficient to maintain said pyrolysis zone at the pyrolysis temperature;

(iii) forming a turbulent mixture of the particulate source of heat, particulate solid carbonaceous material and carrier gas to pyrolyze the particulate solid carbonaceous material and yield a pyrolysis product stream containing as solids, the particulate source of heat and a particulate carbon containing solid residue of pyrolysis, and a vapor mixture of carrier gas and pyrolytic vapors comprising hydrocarbons;

(b) passing the pyrolysis product stream from the pyrolysis reactor to a first separation zone and separating at least the bulk of the solids from the vapor mixture; and (c) forming the particulate source of heat by:

(i) transporting at least a portion of the particulate carbon containing solid residue formed by pyrolysis of the particulate solid carbonaceous material and separated from the vapor mixture to a fluidized bed around a substantially vertically oriented open conduit in open communication with a substantially vertically oriented riser, the conduit and riser comprising a first combustion zone;

(ii) educting particulate carbon containing solid residue from the fluidized bed upwards into the first combustion zone by injecting a gaseous source of oxygen upwardly into the conduit to oxidize carbon in the particulate carbon containing solid residue thereby heating the particulate carbon containing solid residue and to transport particulate carbon containing solid residue and gaseous combustion products of the particulate carbon containing solid residue, including carbon monoxide, to a second combustion zone;

(iii) introducing a source of oxygen into the second combustion zone in an amount at least equal to 50% of the molar feed of carbon monoxide to the second combustion zone for oxidation of such carbon monoxide in the second combustion zone, the total oxygen fed to the first and second combustion zones in combination being sufficient to generate the particulate source of heat; and (iv) passing the formed particulate source of heat and the gaseous combustion products from the second combustion zone to a second separation zone and separating the particulate source of heat from the gaseous combustion products of the particulate carbon containing solid residue and feeding the thusly separated particulate source of heat to the pyrolysis reactor.

5. A process as claimed in claim 4 in which the first separation zone is a cyclone separation zone.

6. A process as claimed in claim 4 in which the second separation zone is a cyclone separation zone.

7. A process as claimed in claim 4 in which the turbulent mixture in the pyrolysis reactor has a solids content ranging from about 0.1 to about 10% by volume based on the total volume of the pyrolysis product stream, and a weight ratio of the particulate source of heat to the particulate solid carbonaceous material of from about 2:1 to about 20:1.

8. A process as claimed in claim 4 in which the pyrolysis temperature is from about 900° to about 1400° F.

9. A process as claimed in claim 4 wherein the pyrolysis reactor has a solids feed inlet for the particulate solid carbonaceous material and a vertically oriented chamber surrounding the upper portion of the pyrolysis reactor, the chamber having an inner peripheral wall forming an overflow weir to a vertically oriented mixing zone of the pyrolysis reactor, wherein the step of transporting particulate solid carbonaceous material to the reactor comprises transporting the particulate solid carbonaceous material contained in a carrier gas to the solids feed inlet, wherein the step of feeding a particulate source of heat to the pyrolysis reactor comprises feeding the particulate source of heat to the vertically oriented chamber surrounding the inlet to the pyrolysis reactor, maintaining the particulate source of heat in the vertically oriented chamber in a fluidized state by a flow of a fluidizing gas substantially nondeleteriously reactive with respect to the products of pyrolysis of the particulate solid carbonaceous material, and discharging the fluidized particulate source of heat over said weir and downwardly into said mixing zone, wherein the step of forming the turbulent mixture comprises injecting the particulate solid carbonaceous material contained in a carrier gas from the solids feed inlet into the mixing zone, and wherein the process comprises the additional step of passing the turbulent mixture downward from the mixing zone to the pyrolysis zone of the pyrolysis reactor to pyrolyze the particulate solid carbonaceous material.

10. The process of claim 9 in which residence time of the carrier gas in the pyrolysis zone of the pyrolysis reactor and the first separation zone in combination is less than about 5 seconds.

11. The process of claim 4 in which residence time of the carrier gas in the pyrolysis zone of the pyrolysis reactor and the first separation zone in combination is less than about 5 seconds.

12. The process of claim 4 in which residence time of the carrier gas in the pyrolysis zone of the pyrolysis reactor and the first separation zone in combination is less than about 3 seconds.

13. A process as claimed in claim 4 in which the particulate solid carbonaceous material is an agglomerative coal substantially of a particle size up to about 250 microns.

14. A process as claimed in claim 4 in which the pyrolysis temperature is from about 600° to about 2000° F.

15. A process as claimed in claim 4 in which the pyrolysis temperature is from about 600° to about 1400° F.

16. A process as claimed in claim 4 in which residence time of the carrier gas in the pyrolysis zone and first separation zone in combination is from about 0.1 to about 3 seconds.

17. A process as claimed in claim 4 in which the second combustion zone comprises a cyclone oxidation-separation zone.

18. A process as claimed in claim 17 in which residence time of the particulate carbon containing solid residue in the cyclone oxidation-separation zone is less than about 5 seconds.

19. A process as claimed in claim 17 in which residence time of the particulate carbon containing solid residue in the cyclone oxidation-separation zone is less than about 3 seconds.

20. A process as claimed in claim 4 in which a substantial portion of the particulate solid carbonaceous material is particles of a size up to about 1000 microns in diameter.

21. A process as claimed in claim 4 in which the particulate solid carbonaceous material is an agglomerative coal and substantially composed of particles of a size less than about 250 microns in diameter.

22. A continuous process for pyrolysis of agglomerative coals which comprises the steps of:

(a) providing a particulate agglomerative coal feed containing agglomerative coal particles of a size less than about 250 microns in diameter;

(b) subjecting the particulate coal feed to flash pyrolysis by continuously:

(i) transporting the particulate agglomerative coal feed contained in a carrier gas which is nondeleteriously reactive with respect to products of pyrolysis of the particulate agglomerative feed to a solids feed inlet of a vertically oriented, descending flow pyrolysis reactor containing a pyrolysis zone operated at a pyrolysis temperature above about 600° F.;

(ii) feeding a particulate source of heat at a temperature above the pyrolysis temperature and comprising heated char resulting from pyrolysis of the particulate agglomerative coal feed to a vertically oriented chamber surrounding the upper portion of the pyrolysis reactor, the chamber having an inner peripheral wall forming an overflow weir to a vertically oriented mixing zone of the pyrolysis reactor, the particulate heat source in said chamber being maintained in a fluidized state by the flow therethrough of a fluidizing gas substantially nondeleteriously reactive with respect to the products of pyrolysis of the particulate agglomerative coal feed;

(iii) discharging the particulate source of heat over said overflow weir and downwardly into said mixing zone at a rate sufficient to maintain said pyrolysis zone at the pyrolysis temperature;

(iv) injecting the particulate agglomerative coal feed and carrier gas from the solids feed inlet into the mixing zone to form a turbulent mixture of the particulate source of heat, the particulate agglomerative coal feed and carrier gas;

(v) passing the resultant turbulent mixture downwardly from said mixing zone to the pyrolysis zone of said pyrolysis reactor to pyrolyze the particulate agglomerative coal feed and yield a pyrolysis product stream containing as solids, the particulate source of heat and char, and a vapor mixture of carrier gas and pyrolytic vapors comprising hydrocarbons;

(c) passing the pyrolysis product stream from said pyrolysis reactor to a first cyclone separation zone and separating at least the bulk of the solids from the vapor mixture;

(d) forming the particulate source of heat by:

(i) transporting at least a portion of the separated solids from the first cyclone separation zone to a fluidized bed around a substantially vertically oriented open conduit in open communication with a substantially vertically oriented riser, the conduit and riser comprising a first combustion zone;

(ii) educting solids from the fluidized bed upwards into the first combustion zone by injecting a gaseous source of oxygen upwardly into the conduit to oxidize carbon in the solids thereby partially heating the solids and transporting partially heated solids and gaseous combustion products of the solids, including carbon monoxide, to a second combustion zone;

(iii) introducing a source of oxygen into the second combustion zone in an amount at least equal to 50% of the molar feed of carbon monoxide to the second combustion zone for oxidation of such carbon monoxide in the second combustion zone, the total oxygen fed to the first and second combustion zones being sufficient to generate the particulate source of heat; and (iv) passing the formed particulate source of heat and gaseous combustion products from the second combustion zone to a second separation zone and separating the particulate source of heat from the gaseous combustion products of the solids for feed of the formed particulate source of heat to the vertically oriented chamber of the pyrolysis reactor;

(e) passing the formed particulate source of heat thusly separated heat to the vertically oriented chamber surrounding the upper portion of the pyrolysis reactor.

23. The process of claim 22 in which the particulate source of heat is passed from the second separation zone to the vertically oriented chamber surrounding the upper portion of the pyrolysis reactor through a vertically oriented standpipe fluidized with a gas which is nondeleteriously reactive with respect to products of pyrolysis of the particulate agglomerative coal feed.

24. The process of claim 22 in which carrier gas residence time in the pyrolysis zone of the pyrolysis reactor and the first cyclone separation zone in combination is less than about 5 seconds.

25. A process as claimed in claim 22 in which the turbulent mixture in the pyrolysis reactor has a solids content ranging from about 0.1 to about 10% by volume based on the total volume of the turbulent mixture and a weight ratio of the particulate source of heat to particulate agglomerative coal feed from about 2:1 to about 20:1.

26. A process as claimed in claim 22, in which the pyrolysis temperature is from about 900° to about 1400° F.

27. A process as claimed in claim 22 in which the pyrolysis temperature is from about 600° to about 2000° F.

28. A process as claimed in claim 22 in which the pyrolysis temperature is from about 600° to about 1400° F.

29. A continuous process for pyrolysis of solid carbonaceous materials comprising the steps of:

(a) subjecting a particulate solid carbonaceous material to flash pyrolysis by continuously:

(i) transporting particulate solid carbonaceous material contained in a carrier gas which is substantially nondeleteriously reactive with respect to products of pyrolysis of the particulate solid carbonaceous material to a vertically oriented, descending flow pyrolysis reactor containing a pyrolysis zone operated at a pyrolysis temperature from about 600° to about 2000° F.;

(ii) feeding a particulate source of heat at a temperature above the pyrolysis temperature and comprising heated particulate carbon containing solid residue of pyrolysis of the particulate solid carbonaceous material to the pyrolysis reactor at a rate sufficient to maintain said pyrolysis zone at the pyrolysis temperature;

(iii) forming a turbulent mixture of the particulate source of heat, particulate solid carbonaceous material and carrier gas and pyrolyzing the particulate solid carbonaceous material to form a pyrolysis product stream containing as solids, the particulate source of heat and a particulate carbon containing solid residue of pyrolysis of the particulate solid carbonaceous material, and a vapor mixture of carrier gas and pyrolytic vapors comprising hydrocarbons;

(b) passing the pyrolysis product stream from the pyrolysis reactor to a first separation zone and separating at least the bulk of the solids from the vapor mixture;

(c) forming the particulate source of heat by:

(i) transporting at least a portion of the separated solids from the first separation zone to a fluidized bed around a substantially vertically oriented riser, the riser and conduit comprising a first combustion zone;

(ii) fluidizing the solids in the fluidizing bed with an upward flow of a fluidizing gas which then passes into the riser through the space between the conduit and the riser;

(iii) educting particulate carbon containing solid residue from the fluidized bed upwards into the first combustion zone by injecting a gaseous source of oxygen upwardly into the conduit and oxidizing carbon in the particulate carbon containing solid residue thereby partially heating the particulate carbon containing solid residue and transporting particulate carbon containing solid residue and gaseous combustion products of the particulate carbon containing solid residue, including carbon monoxide, to a second combustion zone; and (iv) introducing a source of oxygen into the second combustion zone in an amount at least equal to 50% of the molar feed of carbon monoxide to the second combustion zone for oxidation of such carbon monoxide in the second combustion zone, the total oxygen fed to the first and second combustion zones in combination being sufficient to generate the particulate source of heat;

(d) passing the formed particulate source of heat and combustion gases from the second combustion zone to a second separation zone and separating the particulate source of heat from the gaseous combustion product and feeding the separated particulate source of heat to the pyrolysis reactor.

30. The process of claim 29 in which the fluidizing gas contains oxygen to partially oxidize carbon in the separated solids to heat the separated solids in the fluidized bed.

31. A process as claimed in claim 29 in which the pyrolysis temperature is from about 900° to about 1400° F.

32. The process as claimed in claim 29 in which the pyrolysis temperature is from about 600° to about 1400° F.

33. A process as claimed in claim 29 in which a substantial portion of the particulate solid carbonaceous material is particles in the range up to about 1000 microns in diameter.

34. A process as claimed in claim 29 in which the particulate solid carbonaceous material is a particulate agglomerative coal and substantially composed of particles of a size less than about 250 microns in diameter.

35. An apparatus for forming a particulate solid source of heat from a particulate cabon containing solid residue of pyrolysis of a particulate solid carbonaceous material for pyrolysis of the solid carbonaceous material comprising:

(a) a vessel for containing a fluidized bed of a particulate carbon containing solid residue of pyrolysis of a particulate solid carbonaceous material around an open, substantially vertically oriented conduit, said vessel being coupled to one end of a substantially vertically oriented riser in open communication with the conduit, the riser and conduit serving as a first combustion chamber;

(b) a second combustion chamber in communication with the opposed end of the riser;

(c) means for introducing particulate carbon containing solid residue of pyrolysis into the vessel to form the fluidized bed;

(d) means for injecting a gaseous source of oxygen upwardly into the conduit to educt particulate carbon containing solid residue from a fluidized bed of particulate carbon containing solid residue of pyrolysis contained in the vessel upwards first into the conduit and then into the riser to oxidize carbon in the particulate carbon containing solid residue of pyrolysis for heating the particulate carbon containing solid residue in the first combustion chamber with attendant formation of carbon monoxide;

(e) means for introducing oxygen into the second combustion chamber to form the particulate source of heat and to oxidize carbon monoxide; and (f) means for fluidizing a fluidized bed of the particulate carbon containing solid residue of pyrolysis contained by the vessel.

36. An apparatus as claimed in claim 35 in which the conduit is separated from the vertical riser.

37. An apparatus for pyrolysis of solid carbonaceous materials comprising:

(a) a descending flow pyrolysis reactor;

(b) means for forming a turbulent mixture of a particulate source of heat and a particulate solid carbonaceous material contained in a carrier gas for introduction into the pyrolysis reactor to pyrolyze the particulate solid carbonaceous material to form a pyrolysis product stream containing a vapor mixture and, as solids, the particulate source of heat and a particulate carbon containing solid residue of pyrolysis of the particulate solid carbonaceous material;

(c) a first separator for separating at least the bulk of the solids from the vapor mixture in the pyrolysis product stream;

(d) means for transferring the pyrolysis product stream from the pyrolysis reactor to the first separator;

(e) means for forming the particulate source of heat comprising:

(i) a vessel for containing a fluidized bed of the separated solids around an open, substantially vertically oriented conduit, said vessel coupled to one end of a substantially vertically oriented riser in open communication with the conduit, the riser and conduit serving as a first combustion chamber;

(ii) a second combustion chamber in communication with the opposed end of the riser;

(iii) means for introducing a gaseous source of oxygen upwardly into the conduit to educt separated solids contained in the vessel upward into the first combustion chamber and from the first combustion chamber to the second combustion chamber to partially oxidize carbon in the solids to heat the solids in the first combustion chamber with attendant formation of gaseous combustion products including carbon monoxide;

(iv) means for introducing oxygen into the second combustion chamber to further heat the solids to form the particulate source of heat and to oxidize such carbon monoxide;

(v) means for fluidizing separated solids contained by the vessel;

(f) means for passing the separated solids from the first separator to the fluidized bed of the separated solids;

(g) means for transferring the particulate source of heat and gaseous combustion products from the second combustion chamber to a second separator;

(h) a second separator for separating the particulate source of heat from the gaseous combustion products; and (i) means for transferring the separated particulate source of heat from the second separator to the pyrolysis reactor.

38. The apparatus of claim 37 in which the conduit is spaced apart from the riser.

39. The apparatus of claim 37 in which the first separator is a cyclone separator.

40. The apparatus of claim 37 in which the second separator is a cyclone separator.

41. An apparatus as claimed in claim 37 in which the pyrolysis reactor contains a substantially vertically oriented mixing section and a substantially vertically oriented pyrolysis section, and the reactor has a solids feed inlet and a substantially vertically oriented chamber surrounding the upper portion of the reactor, wherein the inner peripheral wall of the chamber forms an overflow weir to the vertically oriented mixing section, and the means for forming a turbulent mixture comprises:

(a) means for feeding particulate source of heat to the vertically oriented chamber;

(b) means for introducing a fluidizing gas into the vertically oriented chamber to maintain the particulate source of heat therein in a fluidized state; and (c) means for injecting the particulate solid carbonaceous material contained in the carrier gas from the solids feed inlet into the mixing section to form the turbulent mixture.

42. An apparatus for pyrolysis of agglomerative coals comprising:

(a) a descending flow pyrolysis reactor containing a substantially vertically oriented mixing section, a substantially vertically oriented pyrolysis section, a solids feed inlet, and a substantially vertically oriented chamber surrounding the upper portion of the reactor, the substantially vertically oriented chamber having an inner peripheral wall forming an overflow weir to the mixing section, wherein a particulate agglomerative coal feed contained in a carrier gas is combined with a particulate source of heat under turbulent flow conditions in the pyrolysis section of the pyrolysis reactor to yield a pyrolysis product stream containing as solids the particulate source of heat and a particulate carbon containing solid residue of pyrolysis of the particulate agglomerative coal feed, and a vapor mixture;

(b) means for feeding the particulate source of heat to the vertically oriented chamber;

(c) means for introducing a fluidizing gas into the substantially vertically oriented chamber to maintain the particulate source of heat therein in a fluidized state;

(d) means for passing the particulate agglomerative coal feed from the solids feed inlet into the mixing section;

(e) a first cyclone separator in communication with the pyrolysis reactor for separating at least the bulk of the solids in the pyrolysis product stream from the vapor mixture in the pyrolysis product stream;

(f) means for forming the particulate source of heat comprising:

(i) a vessel for containing a fluidized bed of the separated solids around an open, substantially vertically oriented conduit, said vessel coupled to one end of a substantially vertically oriented riser in open communication with the vertically oriented conduit and separated therefrom, the riser and conduit serving as a first combustion chamber;

(ii) a second combustion chamber in communication with the opposed end of the riser;

(iii) means for introducing a gaseous source of oxygen upwardly into the conduit to educt separated solids contained in the vessel upward into the conduit and then into the riser and from the riser to the second combustion chamber to partially oxidize carbon in the solids in the first combustion chamber to heat the solids with attendant formation of gaseous combustion products including carbon monoxide;

(iv) means for introducing oxygen into the second combustion chamber to further heat the solids to form the particulate source of heat and to oxidize such carbon monoxide;

(v) means to fluidize separated solids contained by the vessel;

(g) a dipleg from the first cyclone separator to the fluidized bed for transferring the separated solids from the first cyclone separator to the fluidized bed;

(h) a second cyclone separator in communication with the second combustion chamber for separating the particulate source of heat from the gaseous combustion products; and (i) a dipleg from the second cyclone separator to the vertically oriented chamber surrounding the upper portion of the pyrolysis reactor for transferring the particulate source of heat to the pyrolysis reactor.

43. In a process for pyrolysis of particulate solid carbonaceous materials in which a particulate solid carbonaceous material is pyrolyzed by heat transferred thereto by a particulate source of heat to yield a particulate carbon containing solid residue as a product of pyrolysis and in which the particulate source of heat is formed by oxidizing at least a portion of the particulate carbon containing solid residue, the improvement which comprises forming the particulate source of heat by the steps of:

(a) transporting at least a portion of the particulate carbon containing solid residue formed by pyrolysis of the particulate solid carbonaceous material to a fluidized bed around a substantially vertically oriented, open conduit in open communication with a substantially vertically oriented riser, the conduit and riser comprising a first combustion zone;

(b) educting particulate carbon containing solid residue upward from the fluidized bed directly into the first combustion zone by injecting a transport gas upwardly into the conduit to transport particulate carbon containing solid residue to a second combustion zone; and (c) generating the particulate source of heat by combustion of the particulate carbon containing solid residue in a combustion zone in the presence of oxygen.

44. The method of claim 43 in which the conduit is spaced apart from the riser, and the particulate carbon containing solid residue is fluidized in the fluidized bed by an upward flow of a fluidizing gas, and wherein fluidizing gas passes into the riser through the space between the riser and the conduit.

45. The method of claim 43 in which the fluidized bed is fluidized by a fluidizing gas containing oxygen.

46. The method of claim 43 wherein the second combustion zone comprises a cyclone oxidation-separation zone in which carbon in the particulate carbon containing solid residue is oxidized to generate the particulate source of heat and gaseous combustion products of the particulate carbon containing solid residue and simultaneously therewith generated particulate source of heat is separated from such gaseous combustion products.

47. The method of claim 46 in which the source of oxygen is introduced directly into the cyclone oxidation-separation zone.

48. A process as claimed in claim 46 in which residence time of the carbon containing solid residue in the cyclone oxidation-separation zone is less than about 5 seconds.

49. A process as claimed in claim 46 in which residence time of the carbon containing solid residue in the cyclone oxidation-separation zone is less than about 3 seconds.

50. In a process for pyrolysis of particulate solid carbonaceous materials in which a particulate solid carbonaceous material is pyrolyzed by heat transferred thereto by a particulate source of heat to yield a particulate carbon containing solid residue as a product of pyrolysis and in which the particulate source of heat is formed by oxidizing at least a portion of the particulate carbon containing solid residue, the improvement which comprises forming the particulate source of heat by the steps of:

(a) transporting at least a portion of the particulate carbon containing solid residue formed by pyrolysis of the particulate solid carbonaceous material to a fluidized bed around a substantially vertically oriented, open conduit in open communication with a substantially vertically oriented riser, the conduit and riser comprising a first combustion zone;

(b) educting particulate carbon containing solid residue upward from the fluidized bed directly into the first combustion zone by injecting a transport gas comprising oxygen upwardly into the conduit to oxidize carbon in the particulate carbon containing solid residue and partially heating the particulate carbon containing solid residue and transporting the particulate carbon containing solid residue and gaseous combustion products of the particulate carbon containing solid residue, including carbon monoxide, to a second combustion zone; and (c) introducing a source of oxygen into the second combustion zone for oxidation of such carbon monoxide in the second combustion zone to form carbon dioxide, the total oxygen fed to the first and second combustion zones being sufficient to generate the particulate source of heat.

51. The method of claim 50 in which the conduit is spaced apart from the riser, and the particulate carbon containing solid residue is fluidized in the fluidized bed by an upward flow of a fluidizing gas, wherein fludizing gas passes into the riser through the space between the riser and the conduit.

52. The method of claim 50 in which the fluidized bed is fluidized by a fluidizing gas containing oxygen.

53. The method of claim 50 wherein the second combustion zone comprises a cyclone oxidation-separation zone in which carbon monoxide is oxidized to carbon dioxide and simultaneously therewith generated particulate source of heat is separated from such formed carbon dioxide.

54. The method of claim 53 in which the source of oxygen is introduced directly into the cyclone oxidation-separation zone.

55. A process as claimed in claim 53 in which residence time of the particulate carbon containing solid residue in the cyclone oxidation-separation zone is less than about 5 seconds.

56. A process as claimed in claim 53 in which residence time of the particulate carbon containing solid residue in the cyclone oxidation-separation zone is less than about 3 seconds.

57. An apparatus for forming a particulate solid source of heat from a particulate carbon containing solid residue of pyrolysis of a particulate solid carbonaceous material for pyrolysis of the solid carbonaceous material comprising:

(a) a vessel for containing a fluidized bed of a particulate carbon containing solid residue of pyrolysis of a particulate solid carbonaceous material around an open, substantially vertically oriented conduit, said vessel being coupled to one end of a substantially vertically oriented riser in open communication with the conduit;

(b) a combustion chamber in communication with the riser;

(c) means for introducing particulate carbon containing solid residue of pyrolysis into the vessel;

(d) means for injecting a transport gas upwardly into the conduit to educt carbon containing solid residue of pyrolysis contained in the vessel upward first into the conduit and then into the riser and to transport the particulate carbon containing solid residue of pyrolysis to the combustion chamber;

(e) means for introducing oxygen to the combustion chamber to oxidize carbon in the particulate carbon containing solid residue to form the particulate source of heat with attendant formation of combustion gas; and (f) means for fluidizing particulate carbon containing solid residue of pyrolysis contained in the vessel.

58. An apparatus as claimed in claim 57 in which the conduit is separated from the vertical riser.

59. The apparatus of claim 57 in which the combustion chamber is a cyclone for separating formed particulate source of heat from such formed combustion gas.

60. The apparatus of claim 57 in which the means for introducing oxygen comprises means for introducing oxygen directly into the combustion chamber.

* * * * *

UNITED STATES PATENT AND TRADEMARK OFFICE

CERTIFICATE OF CORRECTION

PATENT NO. : 4,243,489

DATED : January 6, 1981

INVENTOR(S) : Norman W. Green

It is certified that error appears in the above-identified patent and that said Letters Patent is hereby corrected as shown below:

At the beginning of the specification, insert "The Government of the United States of America has rights in or in respect of this invention pursuant to Contract No. E (49-18) - 2244 (NOW DE-AC01-76ET10130) awarded by the U.S. Department of Energy."

Signed and Sealed this

*Twenty-fifth* Day of *March 1986*

[SEAL]

*Attest:*

DONALD J. QUIGG

*Attesting Officer*

*Commissioner of Patents and Trademarks*